US010368710B1

(12) United States Patent
Robinson et al.

(10) Patent No.: US 10,368,710 B1
(45) Date of Patent: Aug. 6, 2019

(54) ERGONOMIC MULTI-FUNCTIONAL CLEANING MACHINE

(75) Inventors: Robert S. Robinson, Hamilton, OH (US); Robert G. Robinson, Hamilton, OH (US)

(73) Assignee: Kaivac, Inc., Hamilton, OH (US)

( * ) Notice: Subject to any disclaimer, the term of this patent is extended or adjusted under 35 U.S.C. 154(b) by 0 days.

(21) Appl. No.: 11/823,131

(22) Filed: Jun. 27, 2007

(51) Int. Cl.
*A47L 7/00* (2006.01)
*A47L 11/40* (2006.01)

(52) U.S. Cl.
CPC ..... *A47L 11/4005* (2013.01); *A47L 7/0033* (2013.01); *A47L 11/4072* (2013.01); *A47L 11/4083* (2013.01); *A47L 11/4088* (2013.01); *A47L 11/4094* (2013.01)

(58) Field of Classification Search
USPC ..... 15/320, 321, 323, 327.1, 327, 2, 353; 55/337, 428, 429, DIG. 3
See application file for complete search history.

(56) References Cited

U.S. PATENT DOCUMENTS

| | | | | |
|---|---|---|---|---|
| 4,613,348 | A * | 9/1986 | Natale | 55/318 |
| 4,667,364 | A * | 5/1987 | Meili | 15/320 |
| 4,776,058 | A * | 10/1988 | Garner et al. | 15/320 |
| 4,934,017 | A * | 6/1990 | Kent | 15/321 |
| 5,237,719 | A * | 8/1993 | Dwyer et al. | 15/321 |
| 6,206,980 | B1 * | 3/2001 | Robinson | 134/21 |
| 6,425,958 | B1 | 7/2002 | Giddings et al. | |

(Continued)

OTHER PUBLICATIONS

"Kärcher Cleaning systems. New Multicleaner MC 600. Three-dimensional cleaning with high-pressure extraction.," 7 pages.

*Primary Examiner* — Dung Van Nguyen
(74) *Attorney, Agent, or Firm* — David E. Pritchard

(57) ABSTRACT

In one aspect, the invention is directed to a cleaning machine that includes a fresh liquid tank, a vacuum tank, and an electromechanical assembly—with the electromechanical assembly including an electromechanical housing, a pump, and a vacuum motor. In this particular aspect of the invention, the pump and the vacuum motor are mounted to the electromechanical housing; and the electromechanical assembly is releasably connected to the fresh liquid tank. In another aspect, the invention is directed to a method for rapid replacement of the electromechanical components of the cleaning machine described immediately above. The method includes disconnecting the electromechanical assembly from the fresh liquid tank, and connecting a replacement electromechanical assembly to the fresh liquid tank. The replacement electromechanical assembly includes a replacement electromechanical housing, a replacement pump, and a replacement vacuum motor, with the replacement pump and replacement vacuum motor being mounted to the replacement electromechanical housing. In a further aspect, the invention is directed to a cleaning machine that includes a vacuum tank comprising a suction inlet, a vacuum motor operable to vacuum a soil-containing liquid into the vacuum tank through the suction inlet, and a HEPA filtration assembly constructed and arranged to receive a HEPA filter. In this fashion, air drawn into the vacuum tank through the suction inlet may undergo high efficiency filtration before exiting the cleaning machine.

32 Claims, 13 Drawing Sheets

(56) References Cited

U.S. PATENT DOCUMENTS

| | | | | |
|---|---|---|---|---|
| 7,073,226 | B1 * | 7/2006 | Lenkiewicz et al. | 15/320 |
| 7,272,869 | B1 * | 9/2007 | Robinson | 15/320 |
| 7,627,926 | B2 * | 12/2009 | Williams | 15/320 |
| 2001/0000576 | A1 * | 5/2001 | Robinson | 134/169 C |
| 2005/0055793 | A1 * | 3/2005 | Hauff et al. | 15/320 |

* cited by examiner

ERGONOMIC MULTI-FUNCTIONAL CLEANING MACHINE

CROSS-REFERENCE TO RELATED APPLICATION

This patent document incorporates by reference the entire disclosure of Provisional Application No. 60/816,425, entitled "Ergonomic Multi-Functional Cleaning Machine" and filed on Jun. 26, 2006.

FIELD OF THE INVENTION

This invention relates to commercial/industrial cleaning machines, and in particular, to multi-functional cleaning machines designed for cleaning commercial, industrial, and institutional facilities and the like.

SUMMARY OF THE INVENTION

In one aspect, the invention is directed to a cleaning machine that includes a fresh liquid tank, a vacuum tank, and an electromechanical assembly—with the electromechanical assembly including an electromechanical housing, a pump, a vacuum motor, and a control panel assembly. In this particular aspect of the invention, the pump, the vacuum motor, and the control panel assembly are mounted to the electromechanical housing; and the electromechanical assembly is releasably connected to the fresh liquid tank.

In another aspect, the invention is directed to a method for rapid replacement of the electromechanical components of the cleaning machine described immediately above. The method includes disconnecting the electromechanical assembly from the fresh liquid tank, and connecting a replacement electromechanical assembly to the fresh liquid tank. The replacement electromechanical assembly includes a replacement electromechanical housing, a replacement pump, a replacement vacuum motor, and a replacement control panel assembly—with the replacement pump, the replacement vacuum motor, and the replacement control panel assembly being mounted to the replacement electromechanical housing.

In a further aspect, the invention is directed to a cleaning machine that includes a vacuum tank comprising a suction inlet, a vacuum motor operable to vacuum a soil-containing liquid into the vacuum tank through the suction inlet, and a HEPA filtration assembly constructed and arranged to receive a HEPA filter. In this fashion, air drawn into the vacuum tank through the suction inlet may undergo high efficiency filtration before exiting the cleaning machine.

BRIEF DESCRIPTION OF THE DRAWINGS

The accompanying drawings, which are a part of this specification, illustrate embodiments of the invention. And together with the general description of the invention given above, and the detailed description of the drawings given below, the accompanying drawings explain the principles of the invention.

DETAILED DESCRIPTION OF THE DRAWINGS

Figure 1:
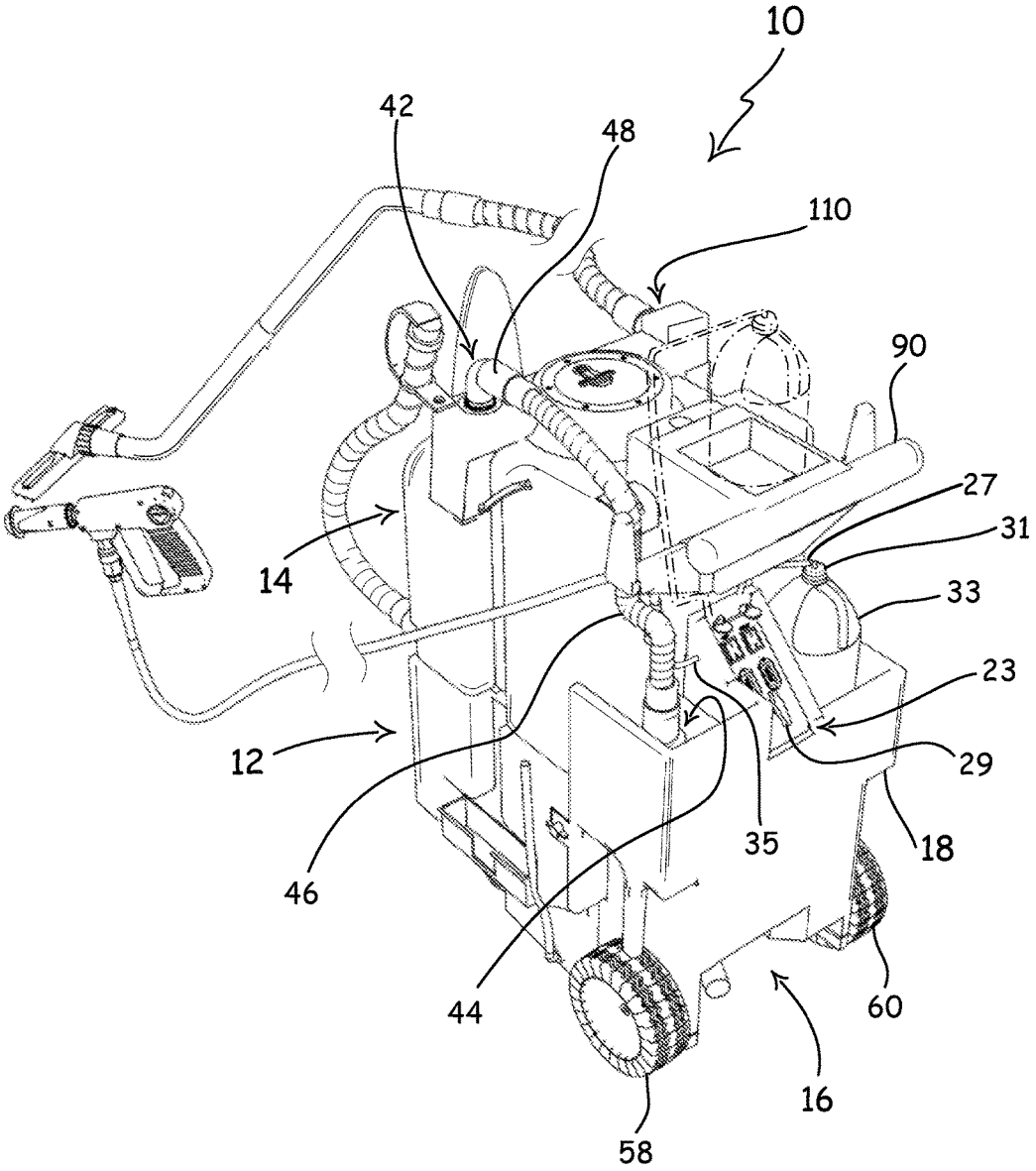
FIG. 1 is a perspective view of an embodiment of the multi-functional cleaning machine, in accordance with the principles of the invention.

With reference to FIGS. 1-12, one ergonomic multi-functional cleaning machine 10, in accordance with the principles of the invention, includes a fresh liquid tank 12, a vacuum (or "vac") tank 14, and an electromechanical assembly 16 releasably connected to the fresh liquid tank 12. The electromechanical assembly 16 includes an electromechanical housing 18, a pump 20, a vacuum motor 22, and a control panel assembly 23—with the pump 20, vacuum motor 22, and control panel assembly 23 being mounted to the electromechanical housing 18.

Each of the fresh liquid tank 12, the vac tank 14, and the electromechanical assembly 16 is a modular component or subassembly of the machine 10, releasably connected to at least one of the other two modular components, and completely separable from the other two modular components. These modular components are connected with hand-operable fasteners (as discussed in detail below). Accordingly, a user may disconnect one or more of the components from the others by hand, without the need for any tools. In similar fashion, a user may reconnect any of the components to the others—or install a replacement modular component—by hand, without the use of any tools. This modular aspect of the machine provides many benefits. For example, a user easily may "swap out" an original electromechanical assembly for a new or refurbished assembly (discussed in detail below), or a user temporarily may remove a component (e.g., the vac tank), to further enhance the portability of the machine.

The electromechanical housing 18 includes a top wall, a bottom wall, a left sidewall, a right sidewall, a front wall, and a back wall. These walls assist in defining a chamber, with the pump 20 and the vacuum motor 22 positioned in the chamber. The housing 18 further includes a large opening in the back wall. In this fashion, when the electromechanical assembly 16 is at least partially disconnected from the fresh liquid tank 12, a user easily may access the chamber via the opening. And when the machine 10 is fully assembled, various surfaces of the fresh liquid tank 12 and the vac tank 14 are adjacent the assembly back wall, thereby advantageously preventing access to the chamber via the opening.

The control panel assembly 23 (see, e.g., FIGS. 1, 3, 4, and 9-11) includes, for example, components for activating the pump 20 and the vacuum motor 22. The control panel assembly may further include other components, one or more of which are discussed below.

The electromechanical assembly 16 includes several other elements, as well. A first length of fresh liquid feed line 30 (FIGS. 3, 4, and 12) extends through an opening in the housing bottom wall, with one end of the feed line connected to a pump inlet, and the other end of the feed line releasably and fluidly connectable to the fresh liquid tank 12. A fresh liquid return line 36 (FIGS. 3, 4, and 12) extends through the back wall opening, with one end of the return line connected to a pump outlet via an unloader portion of a pump outlet fitting, and the other end of the return line releasably and fluidly connectable to the fresh liquid tank 12. If desired, the first length of fresh liquid feed line 30 may be clear braided hose; and the fresh liquid return line 36 may be clear wire-reinforced hose. A second length of fresh liquid feed line 30 (FIGS. 3, 4, and 12) extends through an opening in the top wall, with one end connected to a pump outlet via a pump outlet fitting, and the other end connected to a fresh liquid inlet of a chemical-injection fitting assembly at the top wall. Advantageously, the second length of fresh liquid feed line may be pulse hose. The chemical-injection fitting assembly includes a chemical injector 25 (see, e.g., FIGS. 3, 4, 8, and 10). As discussed in further detail below, the chemical injector 25 fluidly connects the fresh liquid feed line 30 and a chemical draw line assembly.

Figure 8:
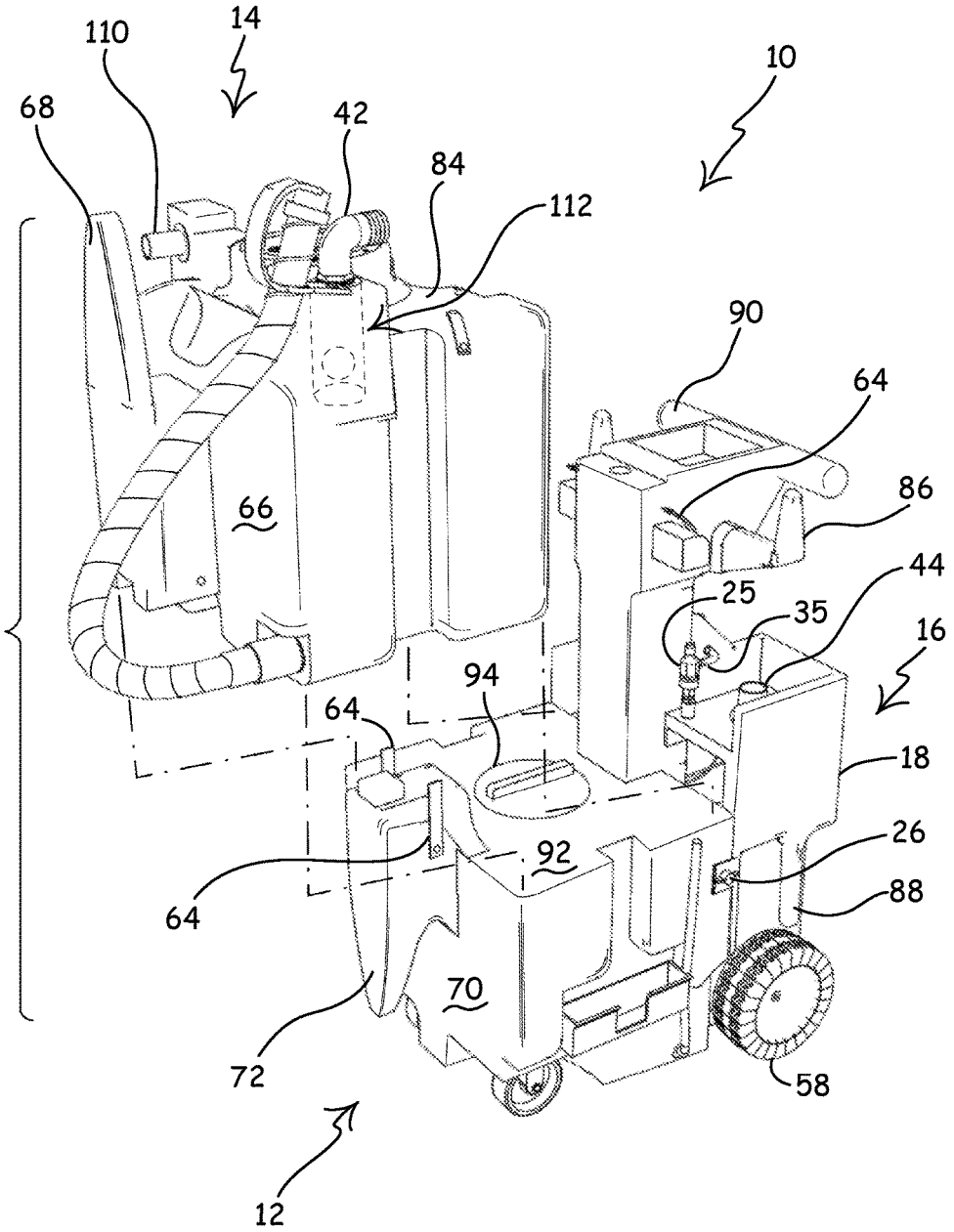
FIG. 8 is a further perspective view of the multi-functional cleaning machine of FIG. 1.
Figure 9:
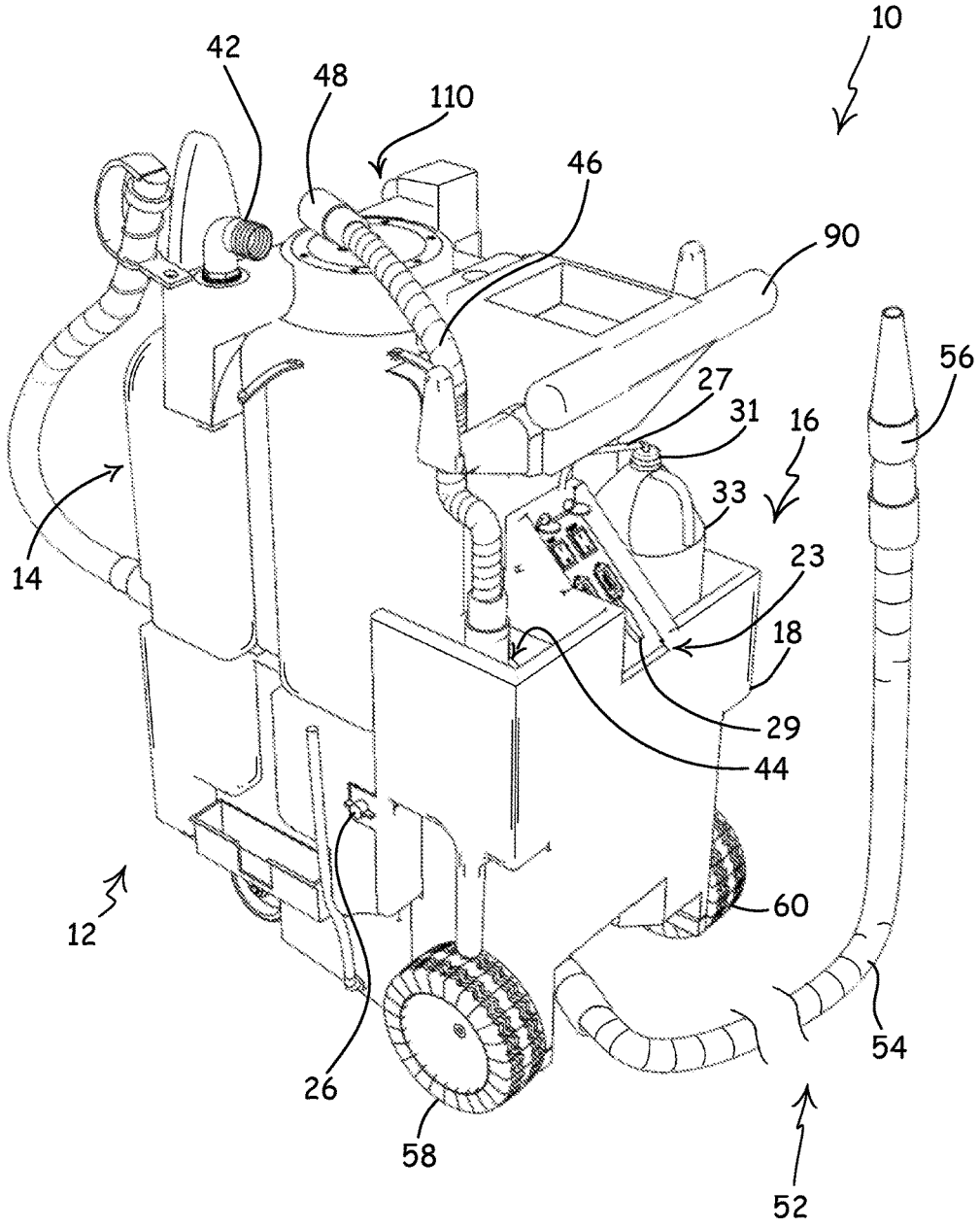
FIG. 9 is an additional perspective view of the multi-functional cleaning machine of FIG. 1.

In addition to the elements described immediately above, the electromechanical assembly 16 includes a chemical draw line assembly. The draw line assembly includes a first length of draw line 27 (FIGS. 1, 3, 4, 9, and 10) that enters the electromechanical housing 18 through an opening at the top wall, adjacent the upper end of the control panel assembly 23. The inner end of this first length 27 is connected to the inlet of an inline valve (not shown), mechanically operable by a rotatable handle 29 (FIGS. 1, 9, and 10) on the control panel assembly 23. The outer end of the first length 27 includes a cap/metering tip subassembly 31 (FIGS. 1, 3, 4, 9, and 10), with the cap for releasable attachment to the mouth of a chemical container 33 (FIGS. 1 and 9). The draw line assembly also includes a second length of draw line 35 (FIGS. 1, 8, and 10) that exits the electromechanical housing 18 through an opening at the top wall, adjacent the left side of the control panel assembly 23. The inner end of this second length 35 is connected to the outlet of the inline valve; and the outer end of this second length 35 is connected to a chemical draw line inlet of the chemical injector 25 of the chemical-injection fitting assembly, at the top wall of electromechanical housing 18.

Any suitable pump and vacuum motor may be used. With regard to the pump, one example is the Model 217 positive-displacement pump available from Pumptec, Inc. of Anoka, Minn. Specs for the Model 217 pump include: 500 PSI (nominal), one GPM (nominal), 3.5 amps, and 115 VAC. With regard to the vacuum motor, one example is a bypass vacuum motor having the following specs: two-stage, 112 CFM, 107 inches of water lift, 11 amps, and 115 VAC. Such vacuum motors are available from Ametek, Inc. of Paoli, Pa.

Figure 2:
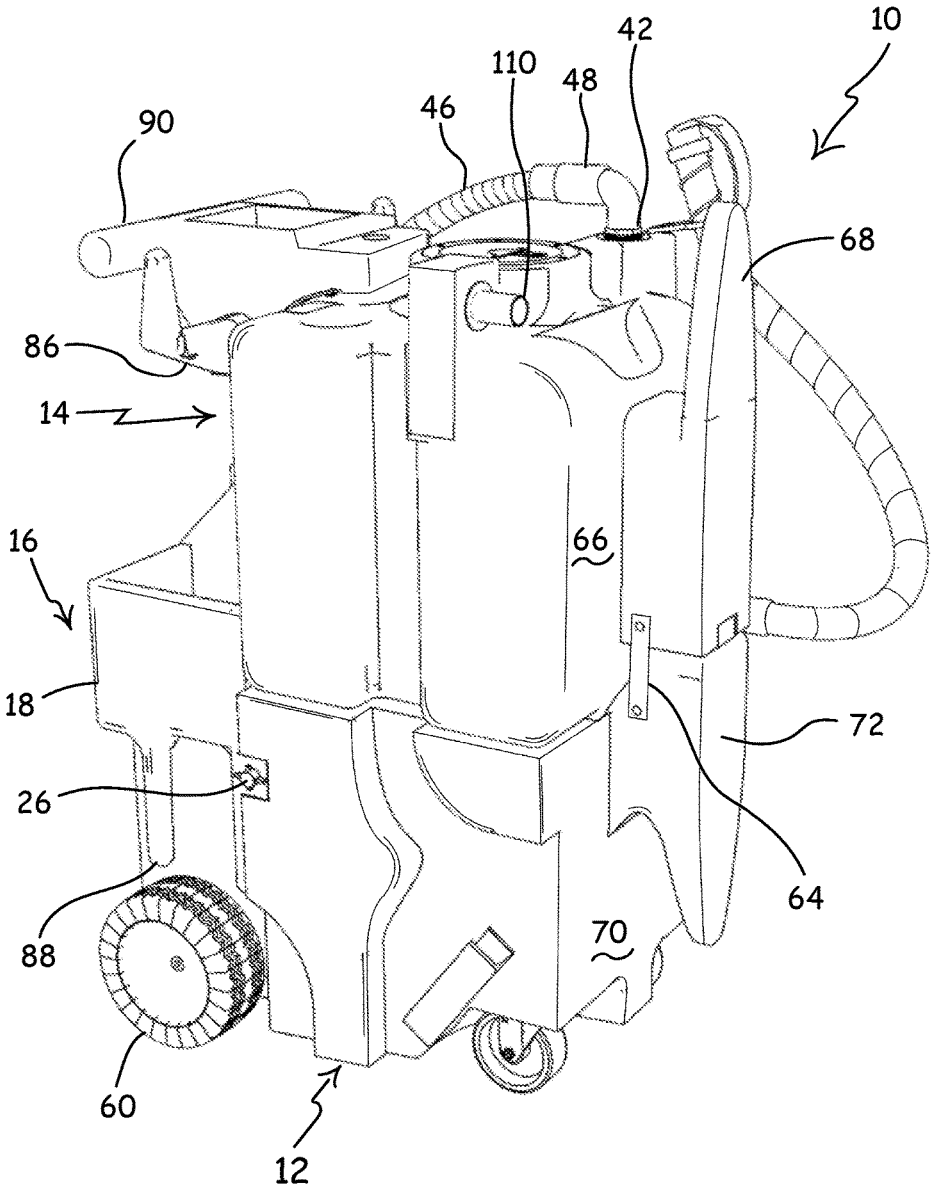
FIG. 2 is a perspective view of the multi-functional cleaning machine of FIG. 1.

As seen in the drawings, a variety of hand-operable fasteners are used to releasably connect various modular components, assemblies, and other elements. For example, and with reference to FIGS. 1, 2, and 8-12, wing bolts, thumb bolts, and worm clamps with wing-type heads are used to advantage. In addition, and with reference to FIGS. 1, 2, 5, and 8-11, straps with male and female snaps also are used. These strap-and-snap assemblies assist in releasably fastening the fresh liquid tank and the vac tank to one another. The assemblies also are useful for releasably securing a tool handle or a vac wand to an embodiment of the multi-functional cleaning machine—particularly when used in cooperation with a support bracket and a channel formed as a part of a left sidewall or a right sidewall. For example, as seen in FIG. 1, the left side of the machine includes a support bracket, channel, and strap-and-snap assembly for securing a floor brush tool or the like. And as seen in FIG. 2, the right side of the machine includes a support bracket, channel, and strap-and-snap assembly (not shown) for securing a vac wand/floor tool combination or the like.

With regard to the HEPA filter, any suitable HEPA filter, having any appropriate HEPA medium or media, may be used. Because HEPA standards may vary from country to country, preferably, such a filter meets or exceeds the stringent U.S. HEPA filtration requirements. One example is an "open-tube" HEPA filter assembly that includes a pleated or fluted HEPA filter paper, a wire support frame surrounding the paper, top and bottom support rings, and top and bottom foam gaskets.

As used in this patent document, the term "door-to-door carrier" means a delivery service that is capable of delivering an electromechanical assembly, as described above, from a supplier to a customer or end-user, and vice versa. One suitable door-to-door carrier is UPS. Other possibly suitable door-to-door carriers may include, for example, the USPS, DHL, or FedEx.

With reference to FIG. 1, the cleaning machine 10 has a fresh liquid tank 12, a vacuum tank 14, and an electromechanical assembly 16. The electromechanical assembly 16 has an electromechanical housing 18, a pump 20 (FIG. 3), a vacuum motor 22 (FIG. 3), and a control panel assembly 23—with the pump 20, the vacuum motor 22, and the control panel assembly 23 being mounted to the electromechanical housing 18, and the electromechanical assembly 16 being releasably connected to the fresh liquid tank 12. The fresh liquid tank 12 has a back 24 (FIGS. 5 and 11), and the electromechanical assembly 16 is at the back 24 (FIG. 11).

Figure 10:
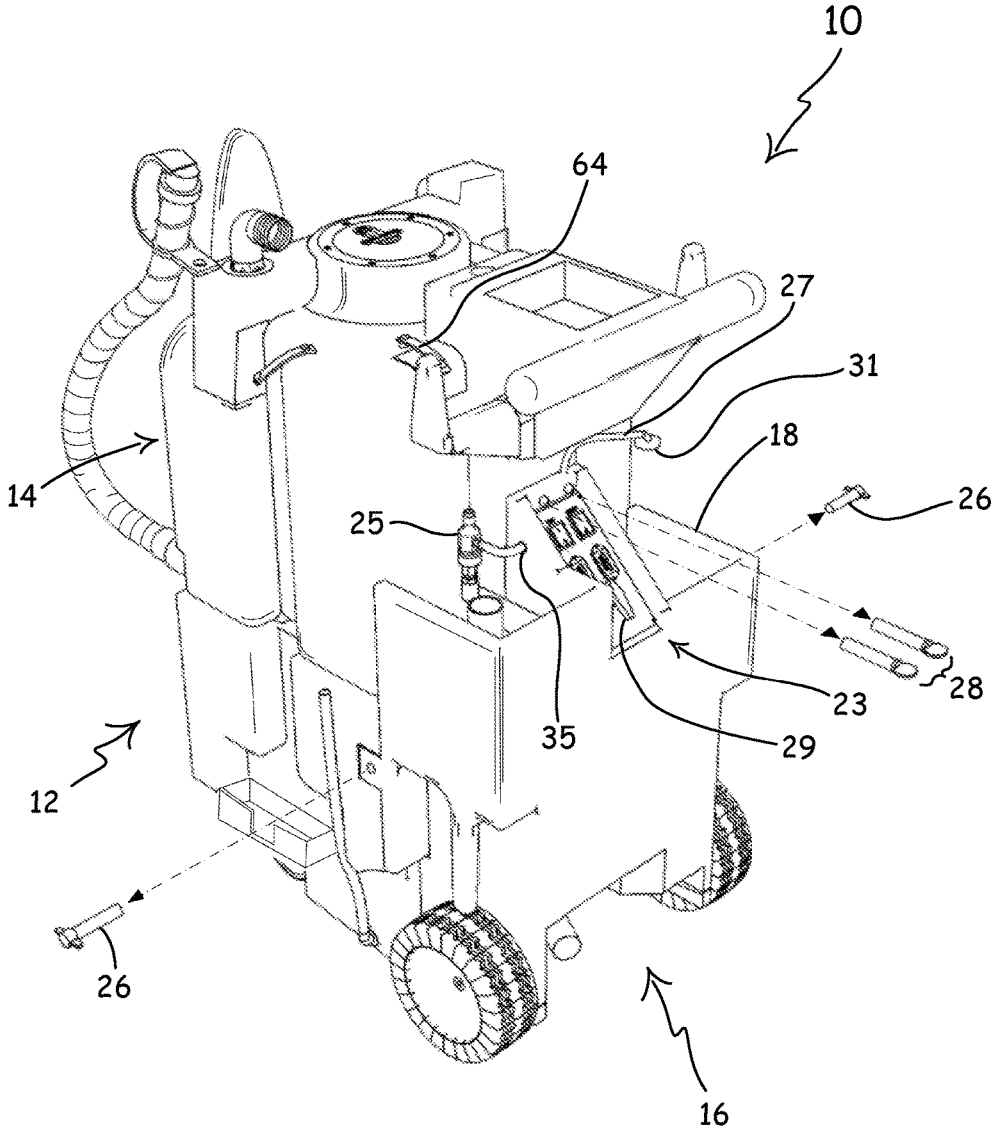
FIG. 10 is yet another perspective view of the multi-functional cleaning machine of FIG. 1.
Figure 11:
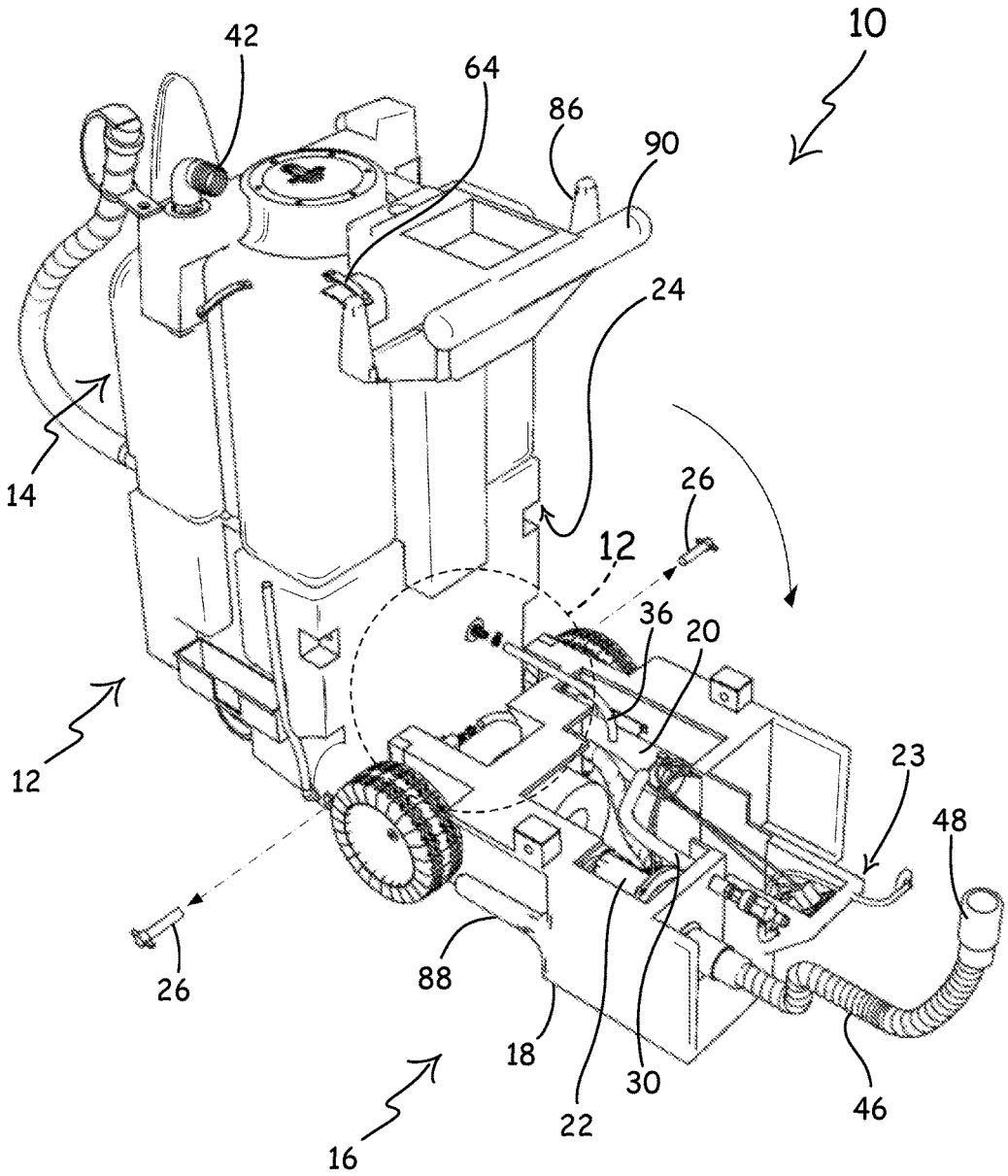
FIG. 11 is a further perspective view of the multi-functional cleaning machine of FIG. 1.

As best seen in FIGS. 10 and 11, the cleaning machine 10 has a number of hand-operable fasteners in the form of wing bolts 26 and thumb bolts 28 that releasably connect the electromechanical assembly 16 to the fresh liquid tank 12. In this fashion, the electromechanical assembly 16 may be connected to or disconnected from the fresh liquid tank 12 by a user without the use of tools.

Figure 3:
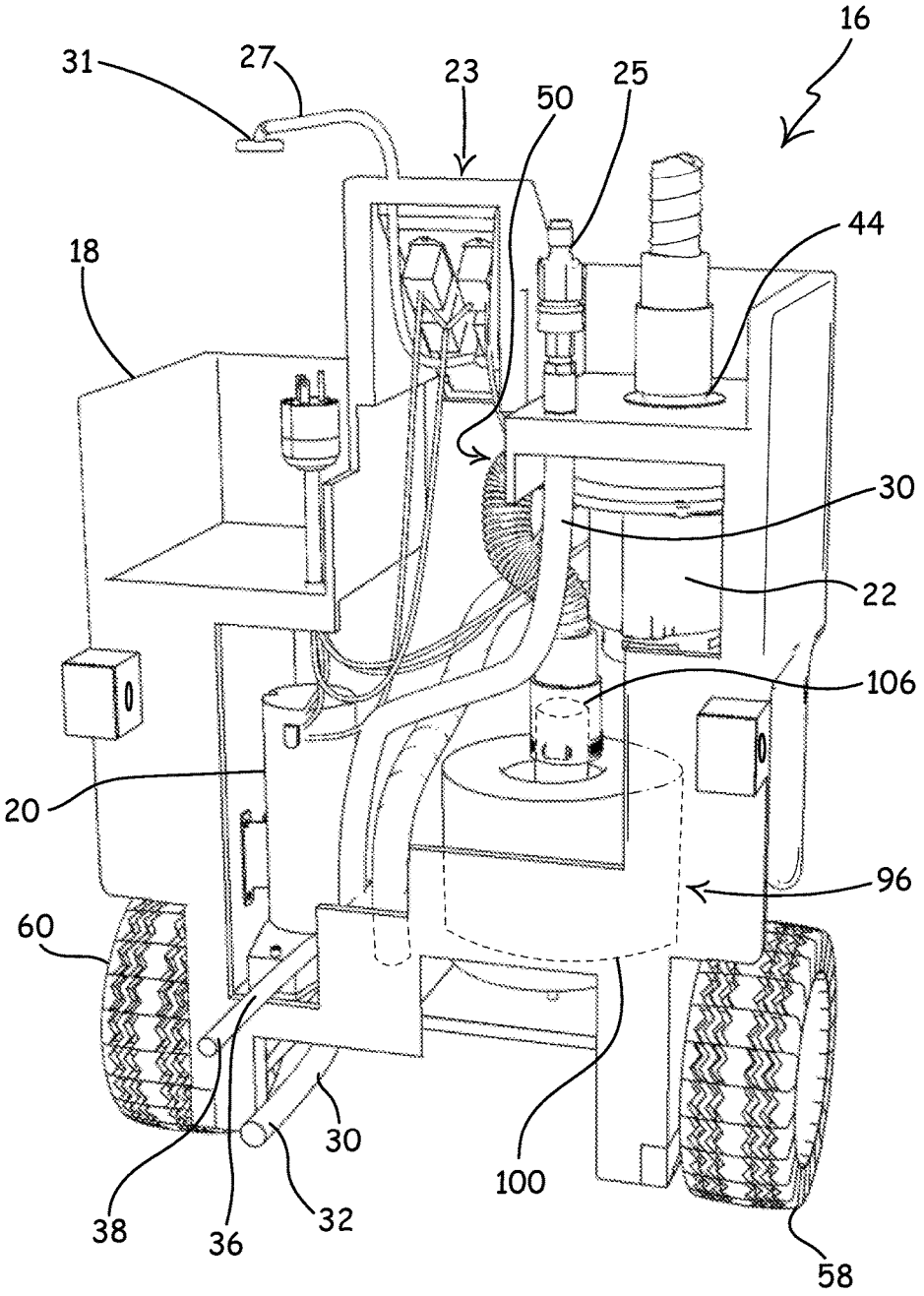
FIG. 3. is a perspective view of the electromechanical assembly of the multi-functional cleaning machine of FIG. 1.
Figure 12:
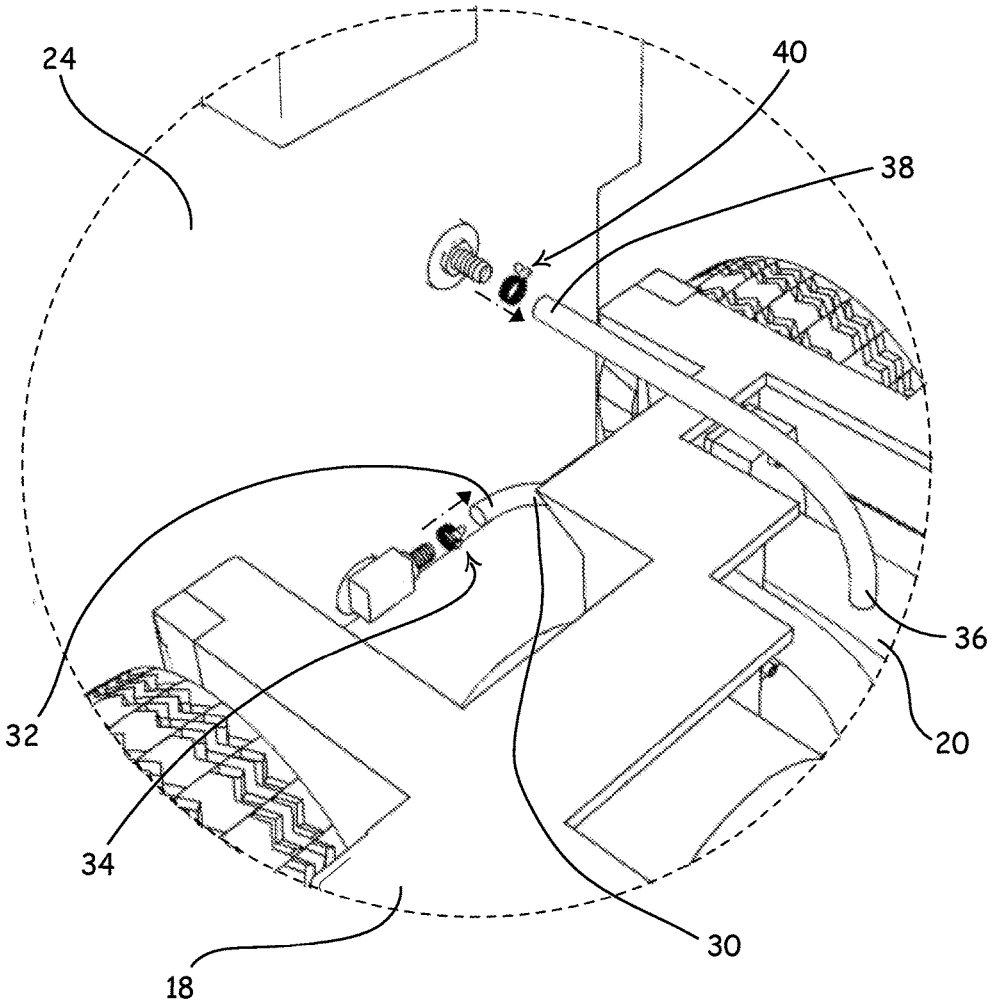
FIG. 12 is an enlarged view of a portion of the cleaning machine of FIG. 11.

Referring to FIGS. 3, 11, and 12, the cleaning machine 10 has a liquid feed line 30 and a quick-disconnect fastener at an end 32 (FIG. 12) of the liquid feed line 30. As shown, the quick-disconnect fastener is in the form of a worm clamp with a wing-type head 34 (FIG. 12). The liquid feed line 30 fluidly connects the fresh liquid tank 12 and the pump 20. In this manner, the end 32 of the liquid feed line 30 easily may be connected to or disconnected from the fresh liquid tank 12. The cleaning machine 10 also has a liquid return line 36 and a quick-disconnect fastener at an end 38 (FIG. 12) of the liquid return line 36. As shown, the quick-disconnect fastener is in the form of a worm clamp with a wing-type head 40 (FIG. 12). The liquid return line 36 fluidly connects the pump 20 and the fresh liquid tank 12. Accordingly, the end 38 of the liquid return line 36 easily may be connected to or disconnected from the fresh liquid tank 12.

As best seen in FIGS. 1, 3, and 9, the vacuum tank 14 has a suction outlet 42 (FIGS. 1 and 9), and the vacuum motor 22 (FIG. 3) has a working air inlet 44 (FIG. 3). The cleaning machine 10 has a length of tubing 46 (FIGS. 1 and 9) that provides fluid communication between the suction outlet 42 and the working air inlet 44. The length of tubing 46 has a releasably connectable end 48 (shown connected in FIG. 1, and disconnected in FIG. 9) that is accessible to a user when the cleaning machine 10 is in an assembled state. In this fashion, a user may bypass the vacuum tank 14 while still operating the vacuum motor 22, simply by disconnecting the releasably connectable end 48 from the suction outlet 42.

With reference to FIGS. 3 and 9, the vacuum motor 22 (FIG. 3) has a working air outlet 50 (FIG. 3); and the cleaning machine 10 has a blower assembly 52 (FIG. 9) constructed and arranged for fluid communication with the working air outlet 50 (FIG. 3). The blower assembly 52 includes a length of blow hose 54 and a blow nozzle 56.

Referring to FIGS. 1-4 and 8-12, the electromechanical assembly 16 has a pair of wheels 58, 60 mounted at the lower end of the assembly 16. The wheels 58, 60 contact a horizontal support surface (e.g., a floor) when the cleaning machine 10 is resting on the horizontal support surface.

As best seen in FIGS. 5-8, the fresh liquid tank 12 (FIGS. 5 and 8) includes a lower portion 62 (FIG. 5), and the vacuum tank 14 (FIGS. 6-8) is releasably positioned on the lower portion 62. A number of hand-operable fasteners in the form of strap-and-snap assemblies 64 (FIGS. 2 and 8) releasably connect the vacuum tank 14 and the fresh liquid tank 12. In this manner, the vacuum tank 14 easily may be connected to or disconnected from the fresh liquid tank 12 by a user without the use of tools.

Referring to FIGS. 2, 5, 6, and 8, the vacuum tank 14 includes a front wall 66 and an upper wrap projection 68 at the front wall 66; and the fresh liquid tank 12 includes a front wall 70 and a lower wrap projection 72 at the front wall 70. The upper wrap projection 68 is adjacent the lower wrap projection 72.

Figure 5:
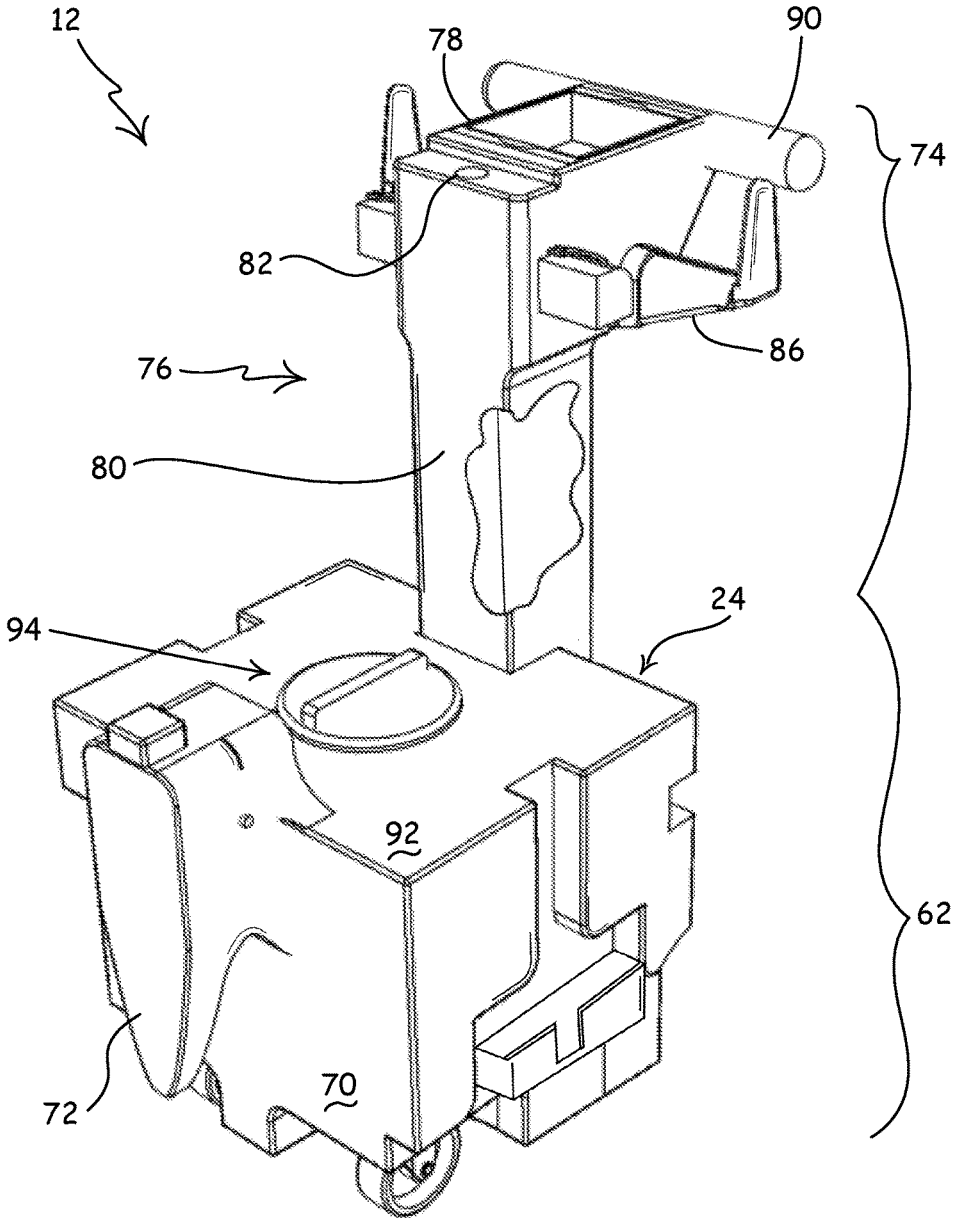
FIG. 5. is a perspective view of the fresh liquid tank of the multi-functional cleaning machine of FIG. 1.
Figure 6:
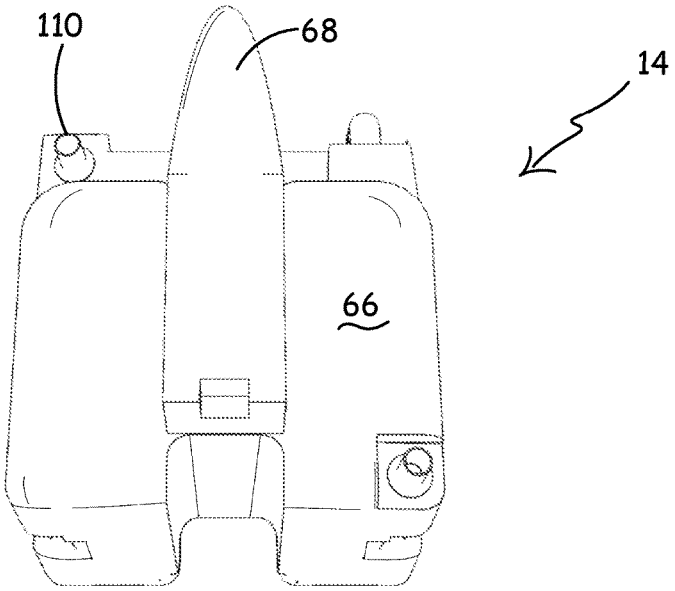
FIG. 6. is a perspective view of the vacuum tank of the multi-functional cleaning machine of FIG. 1.
Figure 7:
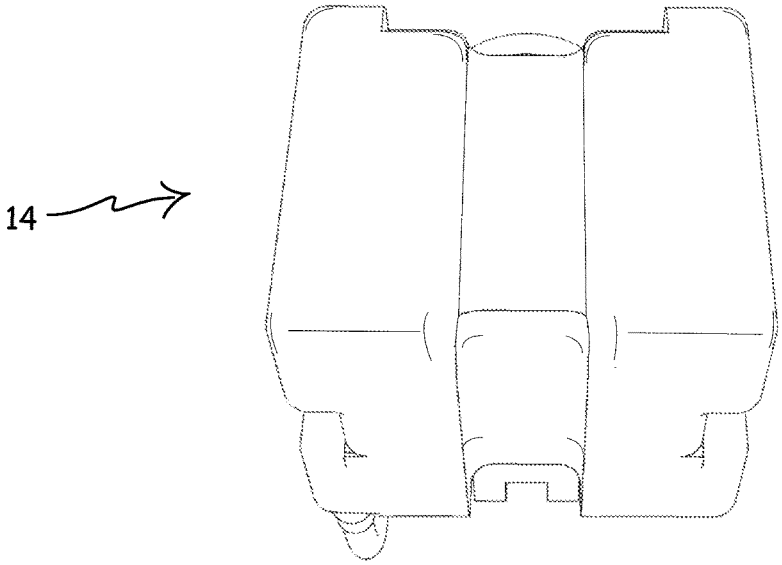
FIG. 7. is another perspective view of the vacuum tank of the multi-functional cleaning machine of FIG. 1.

As best seen in FIG. 5, the fresh liquid tank 12 includes the back 24 and an upper portion 74 at the back 24. The upper portion 74 has a neck 76 and an upper end 78, with the neck 76 having an elongated circumferential sidewall 80, and the upper end 78 having a liquid fill port 82. With reference to FIGS. 2, 5, and 8, the vacuum tank 14 includes a top wall 84 (FIG. 8); and the fresh liquid tank upper end 78 (FIG. 5) is at a height near that of the top wall 84. Referring to FIGS. 2, 5, and 8-11, an upper wrap projection 86 (FIGS. 2, 5, 8, and 11) extends laterally from the fresh liquid tank upper portion 74 (FIG. 5); and a corresponding lower wrap projection 88 (FIGS. 2, 8, and 11) extends laterally from the electromechanical assembly 16. In addition, a handle 90 (FIGS. 1, 2, 5, 8, and 9) extends laterally from the fresh liquid tank upper portion 74 (FIG. 5). As seen in FIGS. 5 and 8, the fresh liquid tank lower portion 62 (FIG. 5) has a top wall 92 (FIGS. 5 and 8) that includes an access port 94 (FIGS. 5 and 8). The access port 94 is inaccessible when the vacuum tank 14 is fully positioned on the fresh liquid tank 12, and accessible when the vacuum tank 14 is separated from the fresh liquid tank 12.

Figure 4:
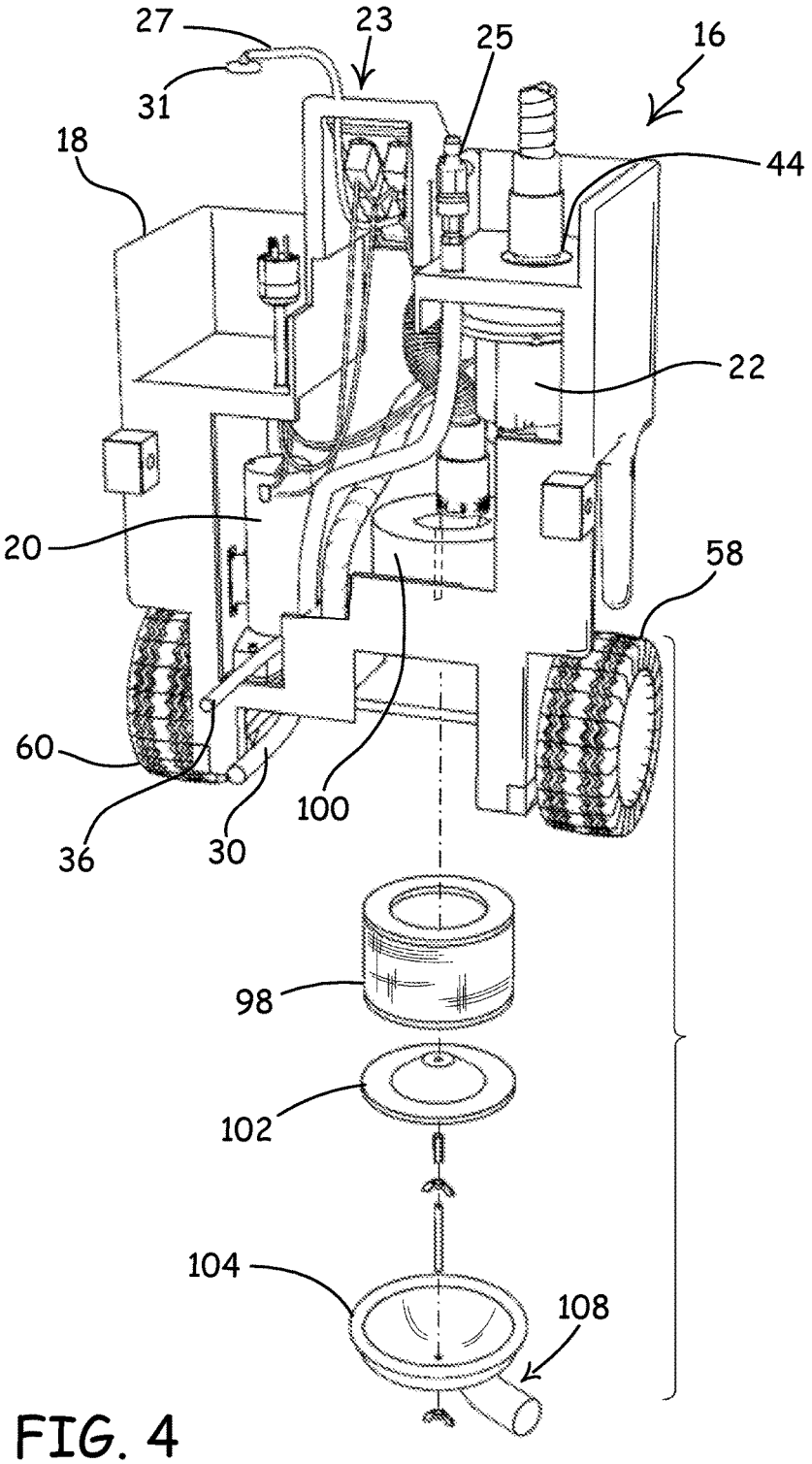
FIG. 4. is another perspective view of the electromechanical assembly of the multi-functional cleaning machine of FIG. 1.

With reference to FIGS. 3 and 4, the electromechanical assembly 16 has a HEPA filtration assembly 96 (FIG. 3) constructed and arranged to removably receive and retain a HEPA filter 98 (FIG. 4). The HEPA filtration assembly 96 includes a housing 100 (FIGS. 3 and 4), a plate 102 (FIG. 4), and a removable cover 104 (FIG. 4). The housing 100 defines a chamber constructed and arranged to receive a HEPA filter 98; and the housing 100 includes an air inlet 106 (FIG. 3). In addition, the housing 100 is integrally formed as a part of the electromechanical assembly 16. The plate 102 is constructed and arranged for placement at a HEPA filter end that is remote from the housing air inlet 106 when a HEPA filter 98 is positioned in the housing 100. In this manner, the plate 102 facilitates the flow of air through the HEPA filter 98. The removable cover 104 includes an opening and a length of tubing that extends outward from the opening, with the opening and length of tubing defining a filtered air outlet 108 (FIG. 4). As seen in FIG. 4, a HEPA filter 98 is removably positioned in the chamber defined by the HEPA filtration assembly housing 100.

Referring to FIGS. 1-4, the vacuum tank 14 includes a suction inlet 110 and the suction outlet 42 (FIGS. 1 and 2); and the vacuum motor 22 includes the working air inlet 44 and the working air outlet 50 (FIGS. 3 and 4). The suction outlet 42 is fluidly connected to the working air inlet 44 (FIG. 1); and the working air outlet 50 is fluidly connected to the HEPA filtration assembly 96 (FIG. 3). Accordingly, air drawn into the vacuum tank 14 through the suction inlet 110 (FIGS. 1, 2, 6, and 8) may undergo high efficiency filtration before exiting the cleaning machine 10.

As noted above, and with reference to FIGS. 3 and 9, the vacuum motor 22 (FIG. 3) has the working air outlet 50 (FIG. 3); and the cleaning machine 10 has the blower assembly 52 (FIG. 9) constructed and arranged for fluid communication with the working air outlet 50 (FIG. 3). The blower assembly 52 includes the length of blow hose 54 and the blow nozzle 56.

As best seen in FIGS. 1, 3, and 9, the vacuum tank 14 has the suction outlet 42 (FIGS. 1 and 9), and the vacuum motor 22 (FIG. 3) has the working air inlet 44 (FIG. 3). The cleaning machine 10 has the length of tubing 46 (FIGS. 1 and 9) that provides fluid communication between the suction outlet 42 and the working air inlet 44. The length of tubing 46 has the releasably connectable end 48 (shown connected in FIG. 1, and disconnected in FIG. 9) that is accessible to a user when the cleaning machine 10 is in an assembled state. In this fashion, a user may bypass the vacuum tank 14 while still operating the blower assembly 52, simply by disconnecting the releasably connectable end 48 from the suction outlet 42.

The electromechanical assembly 16 has a weight and size that satisfy a set of weight and size constraints of a door-to-door shipping carrier, thereby enabling a supplier or a user to ship the electromechanical assembly 16 via a door-to-door shipping carrier.

Referring to FIG. 8, the vacuum tank 14 has a liquid level sensor in the form of a float shut-off assembly 112. This particular assembly 112 includes a float ball in a cage.

Figure 13:
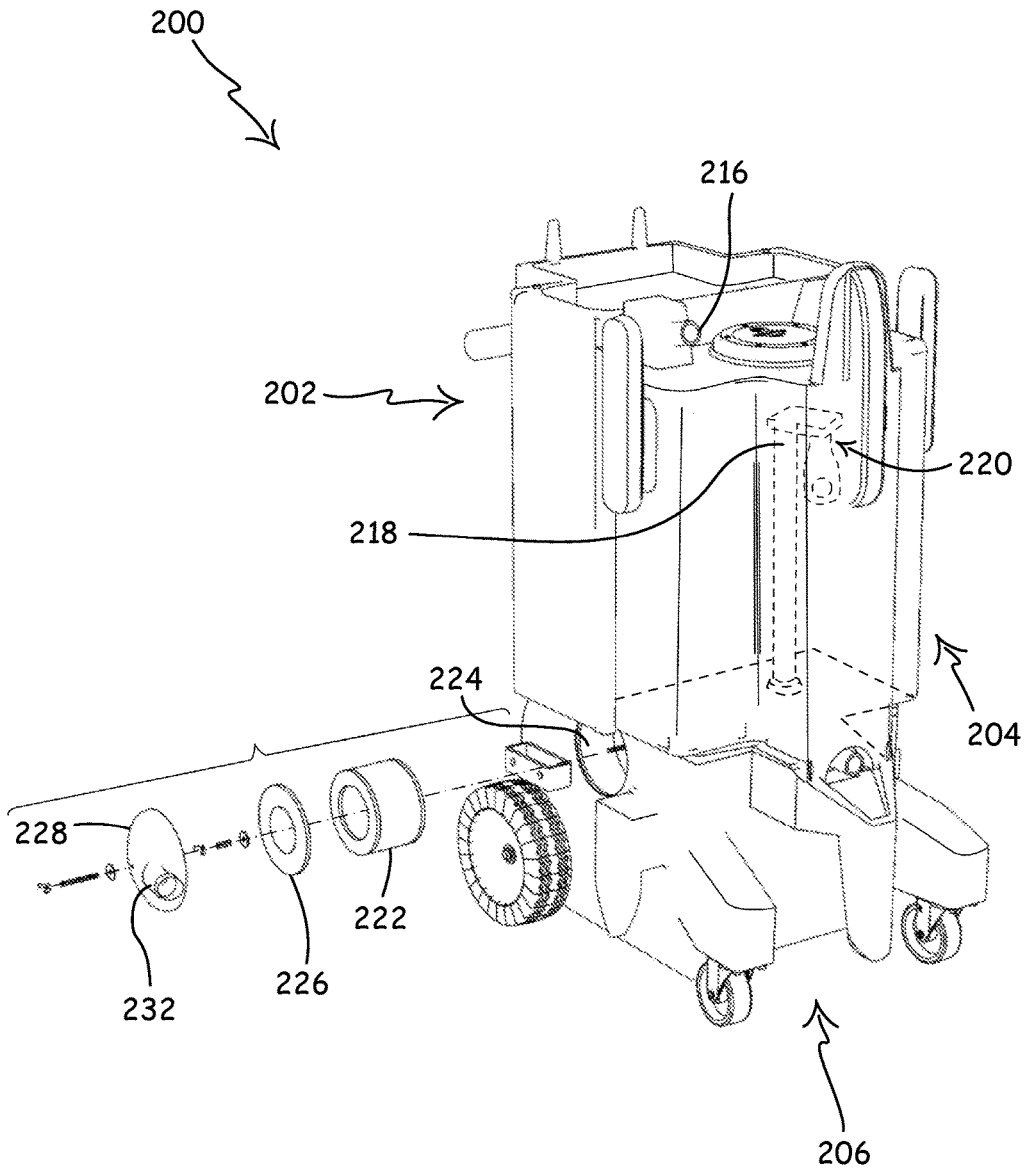
FIG. 13 is a perspective view of another embodiment of the multi-functional cleaning machine, in accordance with the principles of the invention.
Figure 14:
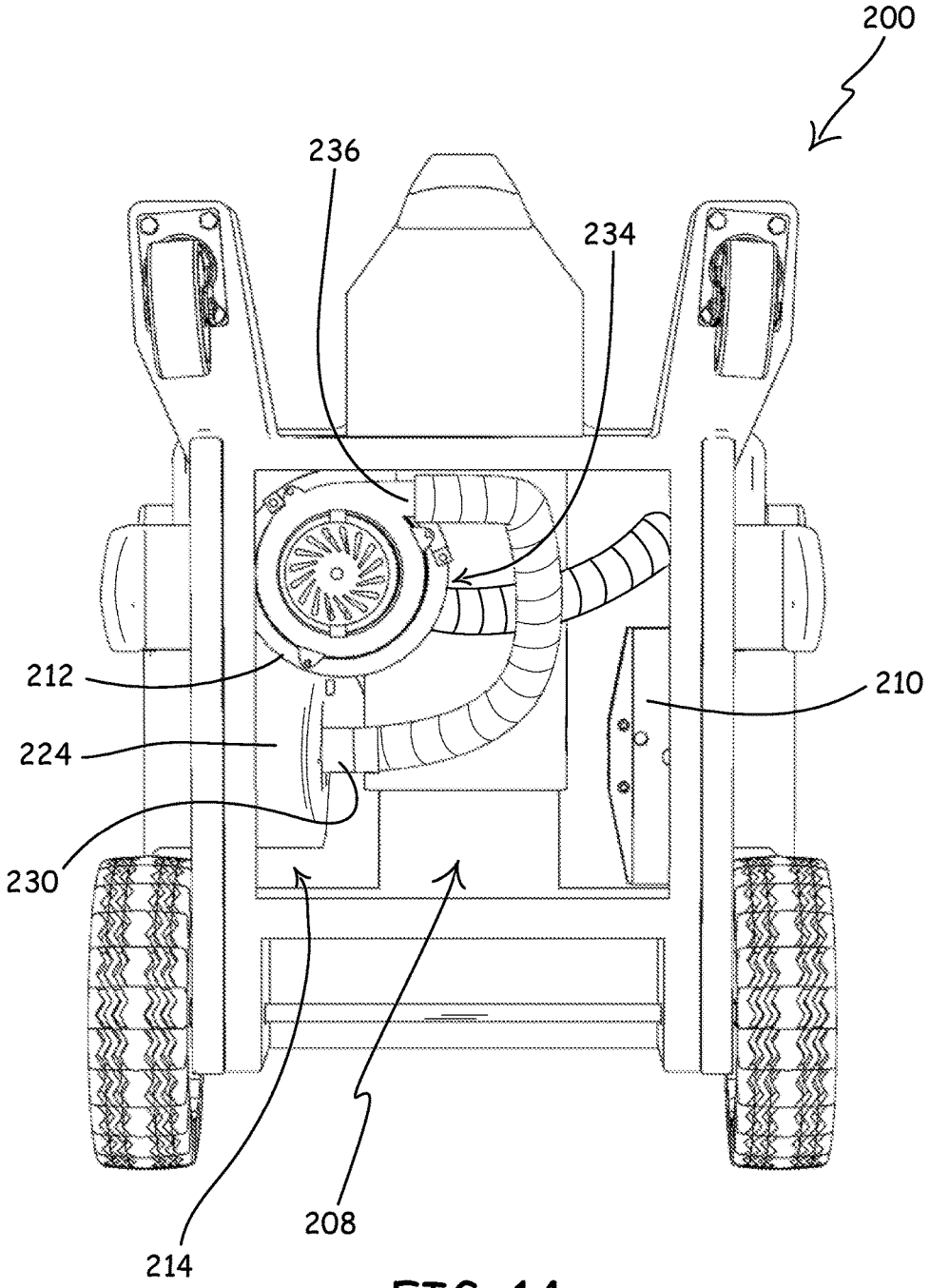
FIG. 14 is an elevated bottom view of the multi-functional cleaning machine of FIG. 13.

With reference to FIGS. 13 and 14, in another embodiment in accordance with the principles of the invention, an ergonomic multi-functional cleaning machine 200 has a fresh liquid tank 202 (FIG. 13) and a vacuum tank 204 (FIG. 13) positioned side by side atop a base assembly 206 (FIG. 13). The base assembly 206 is connected both to the fresh liquid tank 202 and to the vacuum tank 204. The base assembly 206 defines an electromechanical compartment 208 that includes a pump 210, a vacuum motor 212, and a HEPA filtration assembly 214.

The vacuum tank 204 has a suction inlet 216 (FIG. 13), a suction outlet 218 (FIG. 13), and a liquid level sensor 220 (FIG. 13). The suction outlet 218 is in the form of an opening at the top of a standpipe, with the standpipe secured in the interior of the vacuum tank. The liquid level sensor 220 is in the form of a float shut-off assembly. This particular assembly includes a float ball in a porous bag.

The HEPA filtration assembly 214 (FIG. 14) is constructed and arranged to removably receive and retain a HEPA filter 222 (FIG. 13). The HEPA filtration assembly 214 includes a housing 224 (FIGS. 13 and 14), a plate 226

(FIG. 13), and a removable cover 228 (FIG. 13). The housing 224 defines a chamber constructed and arranged to receive a HEPA filter 222; and the housing 224 includes an air inlet 230 (FIG. 14). The plate 226 is constructed and arranged for placement at a HEPA filter end that is remote from the housing air inlet 230 when a HEPA filter 222 is positioned in the housing 224. In this manner, the plate 226 facilitates the flow of air through the HEPA filter 222. The removable cover 228 includes an opening and a length of tubing that extends outward from the opening, with the opening and length of tubing defining a filtered air outlet 232 (FIG. 13). As seen in FIG. 13, a HEPA filter 222 is removably positioned in the chamber defined by the HEPA filtration assembly housing 224.

As noted above, the vacuum tank 204 (FIG. 13) includes the suction inlet 216 and the suction outlet 218. The vacuum motor 212 (FIG. 14) includes a working air inlet 234 and a working air outlet 236 (FIG. 14). The suction outlet 218 (FIG. 13) is fluidly connected to the working air inlet 234 (FIG. 14); and the working air outlet 236 is fluidly connected to the HEPA filtration assembly 214 (FIG. 14). Accordingly, air drawn into the vacuum tank 204 through the suction inlet 216 may undergo high efficiency filtration before exiting the cleaning machine 200.

The following documents are incorporated into this patent document in their entirety by reference: Robinson U.S. Pat. No. 6,206,980; Robinson U.S. patent application Ser. No. 10/685,259 (now Robinson U.S. Pat. No. 7,272,869); Robinson et al. U.S. patent application Ser. No. 11/274,897 (published as Robinson et al. U.S. Patent Application Publication No. 2006/0254020); KaiVac® 1700 Series Operator and Parts Manual; and KaiVac® 2100 Series Operator and Parts Manual.

While the invention has been illustrated by the description of embodiments, and while the embodiments have been described in considerable detail, there is no intention to restrict or in any way limit the scope of the appended claims to such detail. Additional advantages and modifications will readily appear to those who are skilled in the art.

Therefore, the invention in its broadest aspects is not limited to the specific details shown and described. Consequently, departures may be made from the details described herein without departing from the spirit and scope of the claims which follow.

What is claimed is:

1. A cleaning machine, comprising:

a fresh liquid tank;

a vacuum tank; and an electromechanical assembly, the electromechanical assembly including: an electromechanical housing; a pump; a vacuum motor; and a control panel assembly, with the pump, the vacuum motor, and the control panel assembly mounted to the electromechanical housing, and with the electromechanical assembly releasably connected to the fresh liquid tank, the cleaning machine further including a plurality of hand-operable fasteners releasably connecting the electromechanical assembly to the fresh liquid tank, whereby the electromechanical assembly may be connected to or disconnected from the fresh liquid tank by a user without the use of tools.

2. A cleaning machine, comprising:

a fresh liquid tank;

a vacuum tank; and an electromechanical assembly, the electromechanical assembly including: an electromechanical housing; a pump; a vacuum motor; and a control panel assembly, with the pump, the vacuum motor, and the control panel assembly mounted to the electromechanical housing, and with the electromechanical assembly releasably connected to the fresh liquid tank, the cleaning machine further comprising a liquid feed line and a quick-disconnect fastener at an end of the liquid feed line, the liquid feed line operable to fluidly connect the fresh liquid tank and the pump, whereby a user easily may connect or disconnect the end of the liquid feed line.

3. The cleaning machine of claim 2 further comprising a liquid return line and a quick-disconnect fastener at an end of the liquid return line, the liquid return line operable to fluidly connect the pump and the fresh liquid tank, whereby a user easily may connect or disconnect the end of the liquid return line.

4. A cleaning machine, comprising:

a fresh liquid tank;

a vacuum tank; and an electromechanical assembly, the electromechanical assembly including: an electromechanical housing; a pump, a vacuum motor; and a control panel assembly, with the pump, the vacuum motor, and the control panel assembly mounted to the electromechanical housing, and with the electromechanical assembly releasably connected to the fresh liquid tank, wherein the fresh liquid tank includes a lower portion, and the vacuum tank is positioned on the lower portion.

5. The cleaning machine of claim 4 wherein the vacuum tank is releasably positioned on the lower portion.

6. The cleaning machine of claim 5 further including a plurality of hand-operable fasteners releasably connecting the vacuum tank and the fresh liquid tank, whereby the vacuum tank easily may be connected to or disconnected from the fresh liquid tank by a user without the use of tools.

7. The cleaning machine of claim 4 wherein the vacuum tank includes a front wall and an upper wrap projection at the front wall, and the fresh liquid tank includes a front wall and a lower wrap projection at the front wall.

8. The cleaning machine of claim 7 wherein the upper wrap projection is adjacent the lower wrap projection.

9. The cleaning machine of claim 4 wherein the fresh liquid tank includes a back and an upper portion at the back, the upper portion comprising a neck and an upper end, with the neck including an elongated circumferential wall.

10. The cleaning machine of claim 9 wherein the upper end includes a liquid fill port.

11. The cleaning machine of claim 9 wherein the vacuum tank includes a top wall, and the upper end of the fresh liquid tank is at a height near that of the top wall.

12. The cleaning machine of claim 9 further including an upper wrap projection that extends laterally from the upper portion, and a corresponding lower wrap projection that extends laterally from the electromechanical assembly.

13. The cleaning machine of claim 9 further including a handle that extends laterally from the upper portion.

14. The cleaning machine of claim 4 wherein the lower portion includes a top wall, the top wall including an access port, the access port inaccessible when the vacuum tank is fully positioned on the fresh liquid tank, and accessible when the vacuum tank is separated from the fresh liquid tank.

15. A cleaning machine, comprising:

a fresh liquid tank;

a vacuum tank; and an electromechanical assembly, the electromechanical assembly including: an electromechanical housing; a pump; a vacuum motor; and a control panel assembly, with the pump, the vacuum motor, and the control panel assembly mounted to the electromechanical housing, and with the electromechanical assembly releasably connected to the fresh liquid tank, wherein the vacuum tank includes a suction inlet, and the electromechanical assembly includes a HEPA filtration assembly constructed and arranged to receive a HEPA filter, whereby air drawn into the vacuum tank through the suction inlet may undergo high efficiency filtration before exiting the cleaning machine.

16. The cleaning machine of claim 15 wherein the vacuum tank further includes a suction outlet, the vacuum motor includes a working air inlet and a working air outlet, the suction outlet is fluidly connected to the working air inlet, and the working air outlet is fluidly connected to the HEPA filtration assembly.

17. The cleaning machine of claim 15 wherein the HEPA filtration assembly comprises a housing that defines a chamber constructed and arranged to receive a HEPA filter, the housing including an air inlet.

18. The cleaning machine of claim 17 wherein the housing is integrally formed as a part of the electromechanical assembly.

19. The cleaning machine of claim 17 wherein the HEPA filtration assembly further comprises a removable cover, the removable cover including a filtered air outlet.

20. The cleaning machine of claim 19 wherein the removable cover includes an opening and a length of tubing that extends outward from the opening, the opening and length of tubing defining the filtered air outlet.

21. The cleaning machine of claim 17 further comprising a plate, the plate constructed and arranged for placement at a HEPA filter end that is remote from the housing air inlet when a HEPA filter is positioned in the housing, whereby the plate facilitates the flow of air through the HEPA filter.

22. The cleaning machine of claim 15 further comprising a HEPA filter.

23. The cleaning machine of claim 15 wherein the vacuum motor includes a working air outlet, the cleaning machine further comprising a blower-assembly constructed and arranged for fluid communication with the working air outlet, the blower assembly including a length of blow hose and a blow nozzle.

24. The cleaning machine of claim 23 wherein the vacuum tank further includes a suction outlet, and the vacuum motor further includes a working air inlet, the cleaning machine further comprising a length of tubing that provides fluid communication between the suction outlet and the working air inlet, the length including a releasably connectable end that is accessible to a user when the cleaning machine is in an assembled state, whereby a user may bypass the vacuum tank while still operating the blower assembly simply by disconnecting the releasably connectable end.

25. A cleaning machine, comprising:

a fresh liquid tank;

a vacuum tank; and an electromechanical assembly, the electromechanical assembly including: an electromechanical housing; a pump; a vacuum motor; and a control panel assembly, with the pump, the vacuum motor, and the control panel assembly mounted to the electromechanical housing, and with the electromechanical assembly releasably connected to the fresh liquid tank, wherein the electromechanical assembly further includes a fresh liquid feed line, wherein the electromechanical assembly further includes a chemical draw line assembly, wherein the electromechanical assembly further includes a chemical injector, with the chemical injector fluidly connecting the chemical draw line assembly and the fresh liquid feed line, wherein the control panel assembly includes components for activating the pump and the vacuum motor, and wherein the electromechanical assembly further includes a HEPA filtration assembly constructed and arranged to receive a HEPA filter, with the HEPA filtration assembly fluidly connected to the vacuum motor, whereby air drawn into the vacuum tank may undergo high efficiency filtration before exiting the cleaning machine.

26. The cleaning machine of claim 25 wherein the HEPA filtration assembly comprises a housing that defines a chamber constructed and arranged to receive a HEPA filter, with the housing fluidly connected to the vacuum motor.

27. The cleaning machine of claim 25 wherein the vacuum tank includes a suction outlet, and the vacuum motor includes a working air inlet, the cleaning machine further comprising a length of tubing that provides fluid communication between the suction outlet and the working air inlet, the length including a releasably connectable end that is accessible to a user when the cleaning machine is in an assembled state, whereby a user may bypass the vacuum tank while still operating the vacuum motor simply by disconnecting the releasably connectable end.

28. The cleaning machine of claim 27 wherein the electromechanical assembly has a weight and size that satisfy a set of weight and size constraints of a door-to-door shipping carrier, thereby enabling a supplier or a user to ship the electromechanical assembly via a door-to-door shipping carrier.

29. A cleaning machine, comprising:

a fresh liquid tank;

a vacuum tank; and an electromechanical assembly, the electromechanical assembly including: an electromechanical housing; a pump; a vacuum motor; and a control panel assembly, with the pump, the vacuum motor, and the control panel assembly mounted to the electromechanical housing, and with the electromechanical assembly releasably connected to the fresh liquid tank, wherein the electromechanical assembly further includes a HEPA filtration assembly constructed and arranged to receive a HEPA filter, with the HEPA filtration assembly fluidly connected to the vacuum motor, whereby air drawn into the vacuum tank may undergo high efficiency filtration before exiting the cleaning machine.

30. The cleaning machine of claim 29 wherein the HEPA filtration assembly comprises a housing that defines a chamber constructed and arranged to receive a HEPA filter, with the housing fluidly connected to the vacuum motor.

31. The cleaning machine of claim 29 wherein the vacuum tank includes a suction outlet, and the vacuum motor includes a working air-inlet, the cleaning machine further comprising a length of tubing that provides fluid communication between the suction outlet and the working air inlet, the length including a releasably connectable end that is accessible to a user when the cleaning machine is in an assembled state, whereby a user may bypass the vacuum tank while still operating the vacuum motor simply by disconnecting the releasably connectable end.

32. The cleaning machine of claim 31 wherein the electromechanical assembly has a weight and size that satisfy a set of weight and size constraints of a door-to-door shipping carrier, thereby enabling a supplier or a user to ship the electromechanical assembly via a door-to-door shipping carrier.

* * * * *